US007051481B2

(12) United States Patent
Delavega et al.

(10) Patent No.: US 7,051,481 B2
(45) Date of Patent: May 30, 2006

(54) FOLDING COLLAPSIBLE SHELTER

(76) Inventors: Diana Delavega, 4917 NW. 53rd. St., Tamarac, FL (US) 33319; John Delavega, 4917 NW. 53rd. St., Tamarac, FL (US) 33319

( * ) Notice: Subject to any disclaimer, the term of this patent is extended or adjusted under 35 U.S.C. 154(b) by 217 days.

(21) Appl. No.: 10/120,308

(22) Filed: Apr. 10, 2002

(65) Prior Publication Data

US 2003/0192262 A1 Oct. 16, 2003

(51) Int. Cl.
*E04B 1/346* (2006.01)
*E04H 15/36* (2006.01)

(52) U.S. Cl. ..... 52/66; 52/64; 135/133

(58) Field of Classification Search ..... 135/133; 52/64

See application file for complete search history.

(56) References Cited

U.S. PATENT DOCUMENTS

| | | | | | |
|---|---|---|---|---|---|
| 841,719 | A | | 1/1907 | Ross | |
| 1,572,790 | A | | 2/1926 | Grigsby | |
| 2,598,940 | A | * | 6/1952 | Robie | 135/133 |
| 2,728,115 | A | | 12/1955 | Cornelius | |
| 3,906,968 | A | * | 9/1975 | Black | 135/132 |
| 4,084,599 | A | * | 4/1978 | Matthews | 135/132 |
| 4,106,520 | A | | 8/1978 | Warner et al. | |
| 4,227,542 | A | * | 10/1980 | Bonfilio | 135/132 |
| 4,306,390 | A | | 12/1981 | Brown | |
| 4,402,544 | A | * | 9/1983 | Artim et al. | 296/110 |
| 4,425,929 | A | * | 1/1984 | Von Mosshaim | 135/132 |
| 4,886,083 | A | | 12/1989 | Gamache | |
| 5,085,240 | A | * | 2/1992 | Littledeer | 135/132 |
| 5,159,947 | A | * | 11/1992 | Chuang et al. | 135/132 |
| 5,507,121 | A | | 4/1996 | Taylor | |
| 5,625,982 | A | | 5/1997 | Foote | |
| 5,746,237 | A | | 5/1998 | Arnic | |
| 5,842,495 | A | * | 12/1998 | Egnew et al. | 135/133 |
| 6,052,951 | A | | 4/2000 | Daoud | |

FOREIGN PATENT DOCUMENTS

| | | | | |
|---|---|---|---|---|
| DE | 19757075 | A1 | * | 6/1999 |
| GB | 2177737 | A | * | 1/1987 |
| JP | 10159394 | A | * | 6/1998 |

* cited by examiner

*Primary Examiner*—Anita M. King
(74) *Attorney, Agent, or Firm*—Brinkley, McNerney et al.; Kevin P. Crosby, Esq.

(57) ABSTRACT

A shelter to enclose articles of personal property such as motorcycles, bicycles, lawn and garden equipment, etc. comprising a base frame mounted coextensively in horizontal fashion to the ground, a plurality of u-shaped rib members covered by a suitable covering material which articulate around a novel hinge mechanism and which are essentially equally spaced in spanning relation over the base when in the first, covering, position and which are collapsed upon themselves in stacked relation when in the second, opened, position. A motor and gear assembly may be employed to permit automated operation of the device, or the device may be manually operated.

14 Claims, 9 Drawing Sheets

FOLDING COLLAPSIBLE SHELTER

BACKGROUND OF THE INVENTION

1. Field of the Invention

This invention relates to shelters and, more particularly, relates to a shelter assembly in which personal property can be stored and which can be opened from either side, either manually or by a motorized system, in either case permitting for essentially full opening in either direction of the cover by the use of independently articulating cover-supporting ribs.

2. Background Art

Enclosures for sheltering personal possessions such as motorcycles, bicycles, lawn and garden equipment, etc. are highly desirable but typically prohibitively expensive, so much so that a typical homeowner or tenant cannot afford a residence equipped with one. Consequently, the homeowner or tenant either forgoes ownership of such sought after personal belongings or suffers the consequence of premature deterioration due to exposure to the elements.

Rudimentary efforts at protecting such belongings begin with draped covers made of flexible sheets, typically of waterproof material. These types of covers provide extremely quick and easy access to the property covered thereby.

Other attempts at protecting items of personal property are disclosed in the following U.S. Pat. No. 6,052,951 to Daoud; U.S. Pat. No. 5,746,237 to Arnic; U.S. Pat. No. 5,625,982 to Foote; U.S. Pat. No. 5,507,121 to Taylor; U.S. Pat. No. 4,886,083 to Gamache; U.S. Pat. No. 4,306,390 to Brown; U.S. Pat. No. 4,106,520 to Warner, et al.; U.S. Pat. No. 2,728,115 to Cornelius; U.S. Pat. No. 1,572,790 to Grigsby; and U.S. Pat. No. 841,719 to Ross. As will be described hereinafter, the cover of the present invention differs from those previously proposed in a significant number of ways which will be described in more detail herein below. Among the shortcomings overcome by the instant invention are the inadequacies in the various mechanisms about which the prior art covers hinge and the operability of the covers in terms ease of opening and closing the shelters.

It is, therefore, an object of the present invention to provide a shelter that is easy to use and does not require one to manually unfold and install a cover over articles of personal property.

It is also an object of this invention to provide a shelter for articles of personal property which opens from either side to permit access to and permit removal from or placement of articles within the shelter from either side and which opens essentially as wide as if no cover were employed.

It is also an object of this invention to provide a shelter for articles of personal property which can be opened and closed, and locked closed or opened, or hold in any one of a plurality of intermediate positions.

It is also an object of this invention to provide a shelter having an articulating cover which employs an extremely durable and versatile hinging apparatus.

It is another object of the invention to provide a portable cover that fully collapses to the ground on either side of the space covered by the cover.

SUMMARY OF THE INVENTION

In accordance with the invention, I have provided a shelter to enclose articles of personal property such as motorcycles, bicycles, lawn and garden equipment, etc. comprising a base frame mounted coextensively in horizontal fashion to the ground, a plurality of u-shaped rib members covered by a suitable covering material which articulate around a novel hinge mechanism and which are essentially equally spaced in spanning relation over the base when in the first, covering, position and which are collapsed upon themselves in stacked relation when in the second, opened, position. A motor and gear assembly may be employed to permit automated operation of the device, or the device may be manually operated.

Although the cover may be hinged relative to the base frame in any manner which will be apparent to those skilled in the art, a particularly suitable hinge mechanism is disclosed herein as having a pair of ground brackets, one on each lateral side of the base frame. Each ground bracket has pivotally connected thereto a front flange and a rear flange through respective pivot pins. In addition, one-half of the ribs are pivotally connected to the front flange and one-half of the ribs are pivotally connected to the rear flange. The pivot pins are rotated by the motor and gear mechanism in the embodiment in which the ribs are moved automatically rather than manually.

The cover is preferably of a flexible, light weight, weather resistant material selected from the group consisting of: canvas, plastic, nylon, vinyl, rubber and fabric. Alternatively, the cover may be made of hard plastic or metalized material, which may necessitate utilizing hinges between sections. It is also contemplated that the invention not be limited to use with any particular personal property items mentioned herein, which are referred to by way of example but not limitation.

Other objects, features and advantages of my invention will become more readily apparent upon reference to the following description when taken in conjunction with the accompanying drawings.

DESCRIPTION OF A PREFERRED EMBODIMENT

Figure 1A:
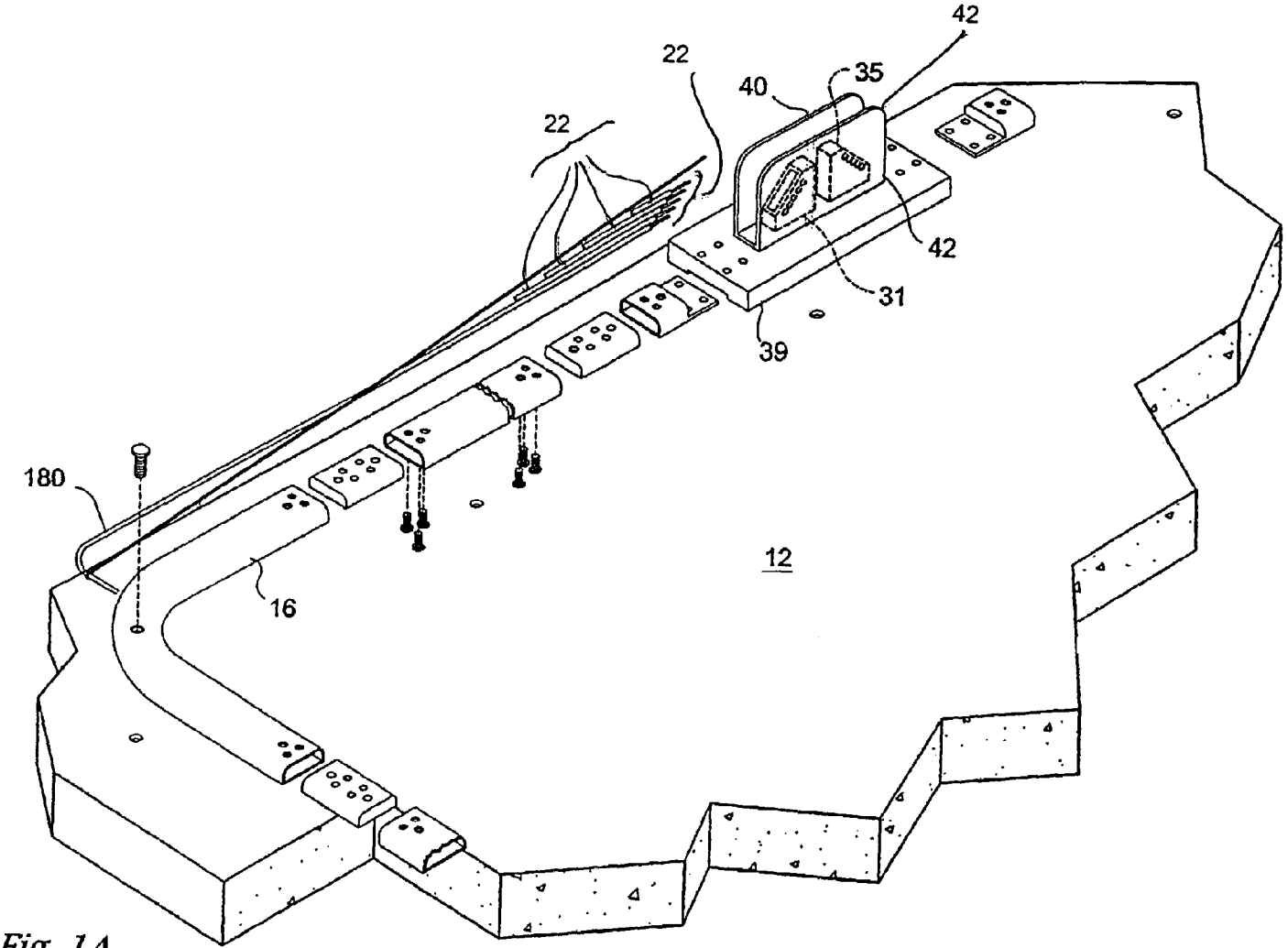
FIG. 1A is a perspective, exploded, partial view of a portion of the instant invention.
Figure 1B:
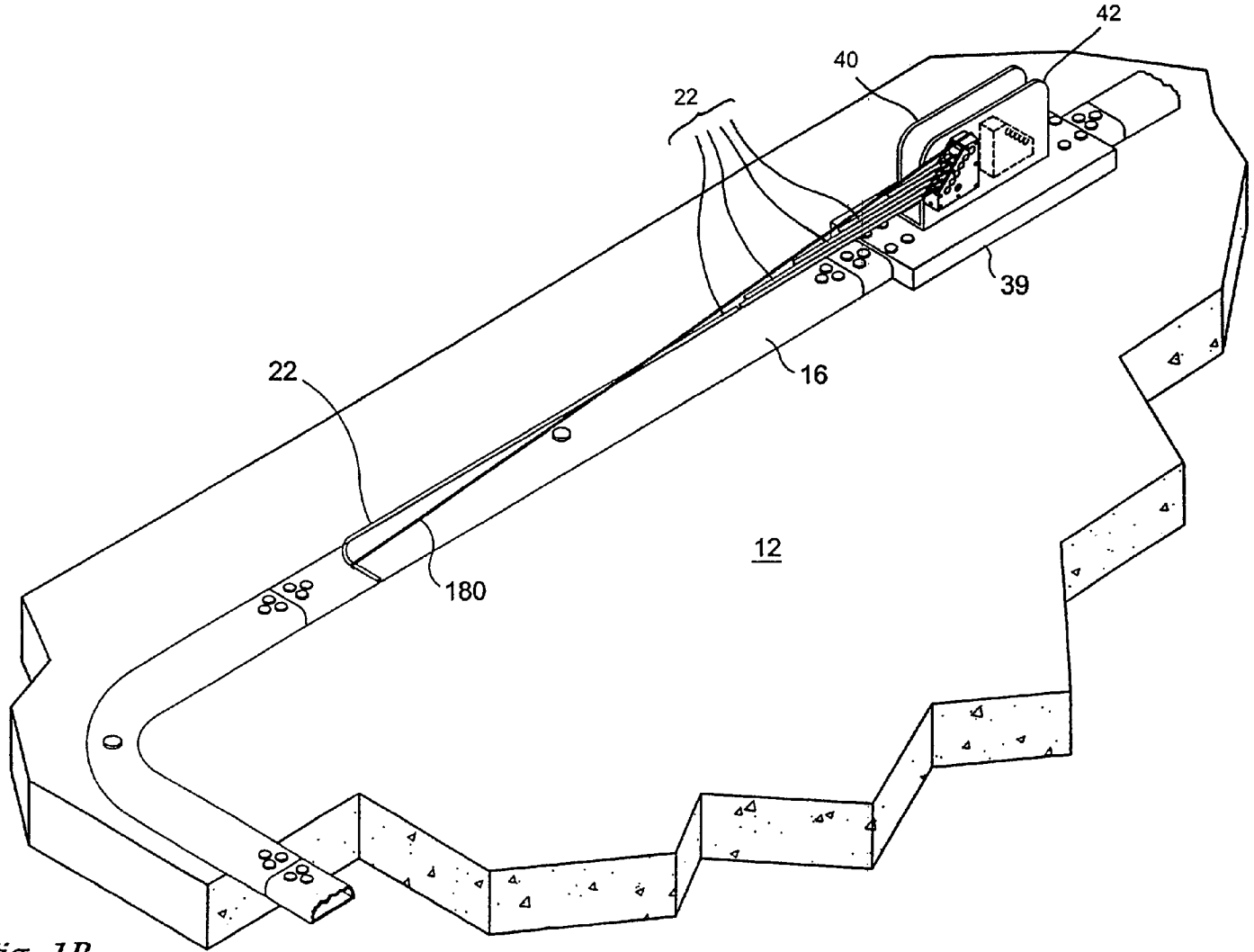
FIG. 1B is a perspective, assembled, partial view of the portion of the invention shown in FIG. 1A.

FIGS. 1 through 9 illustrate the preferred form of my invention which is a personal articles shelter (10) attached to a sub-floor (12), the shelter including, inter alia, a base frame (16) which, in the preferred embodiment, is elliptical in shape but may be any desired shape to suit the circumstances. When discussing orientation, the end (16*a*) shown in FIG. 4 will be considered the front or forward end, the end indicated as (16*b*) will be referred to as the back or rear end, and (16*c*) and (16*d*) refer to the left and right sides of the shelter, respectively.

A cover (20) is pivotally associated with frame (16) in a manner to be set forth hereinafter. The cover (20) may be comprised of a plurality of U-shaped ribs (22) over (or under) which is disposed a covering material (23) which may be, as mentioned above, canvas, plastic, nylon, vinyl, rubber, fabric, metal or any other suitable material as will occur to one of skill in the art. All that is required is that the cover be flexible so that the ribs can collapse toward each other as either or both ends of the cover are opened. It is preferred that the material be weather resistant, light weight.

Figure 2:
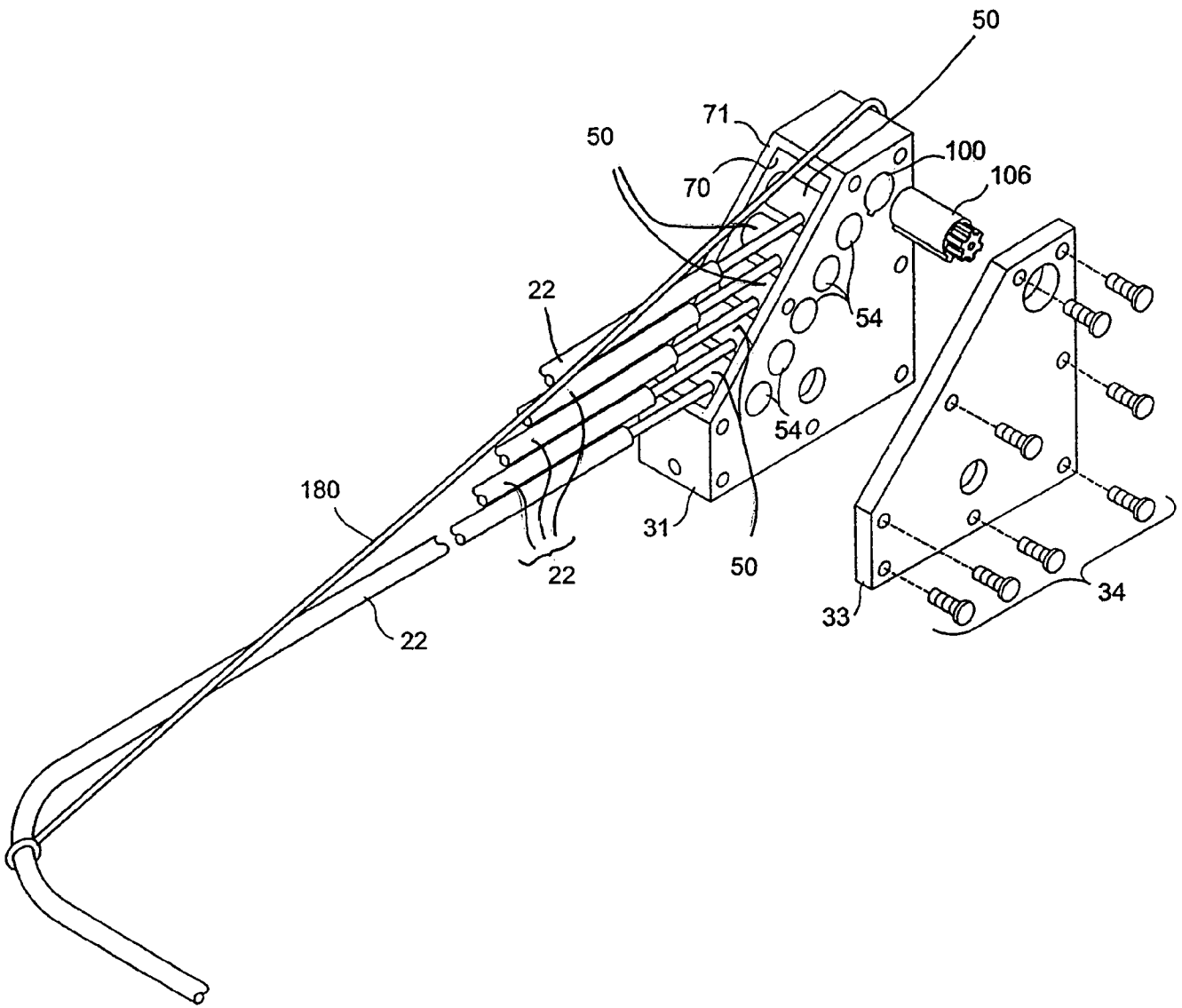
FIG. 2 is a perspective, partially exploded view of the novel hinge apparatus of the invention.
Figure 4:
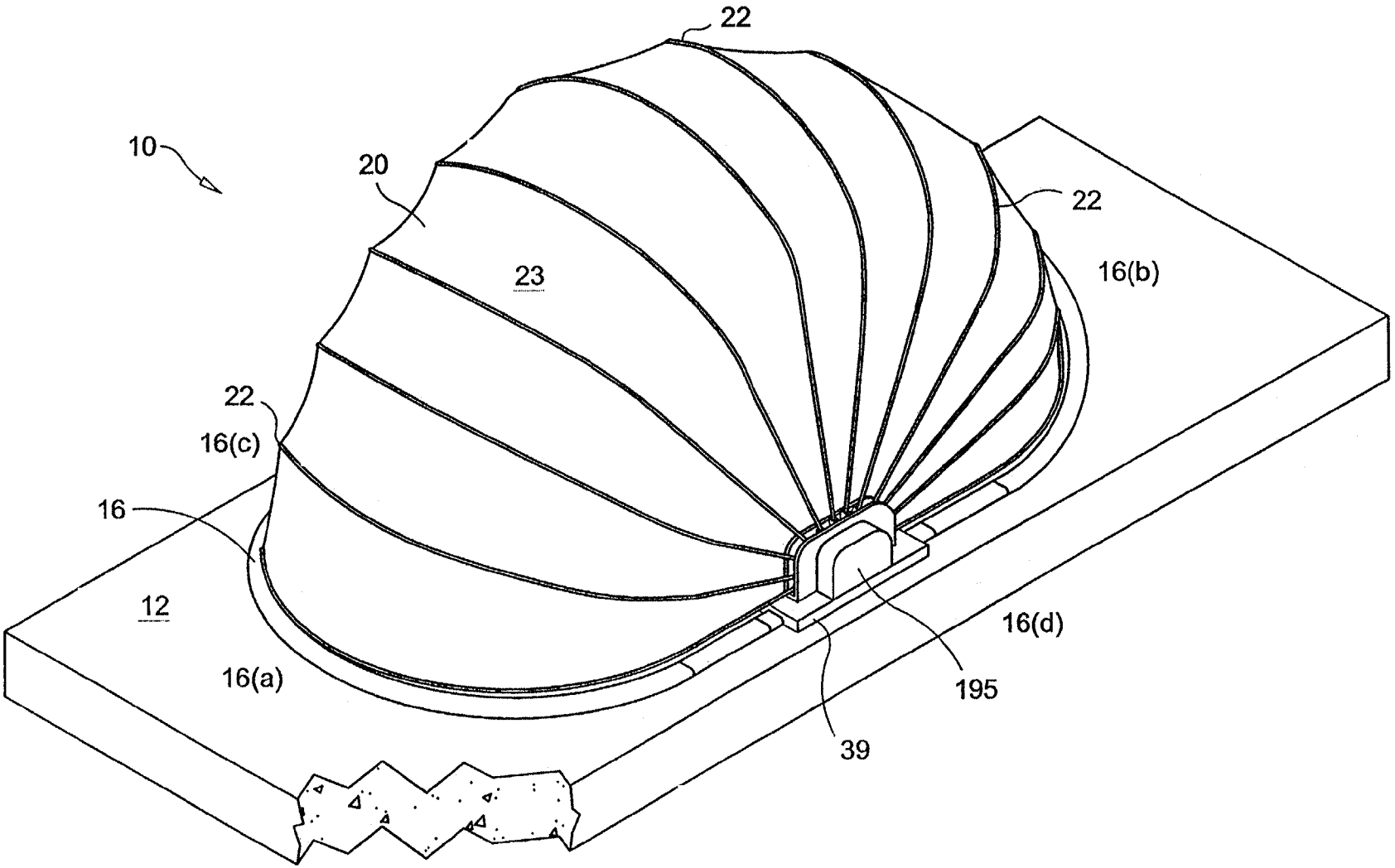
FIG. 4 is a perspective view of an assembled shelter in the closed state.
Figure 5:
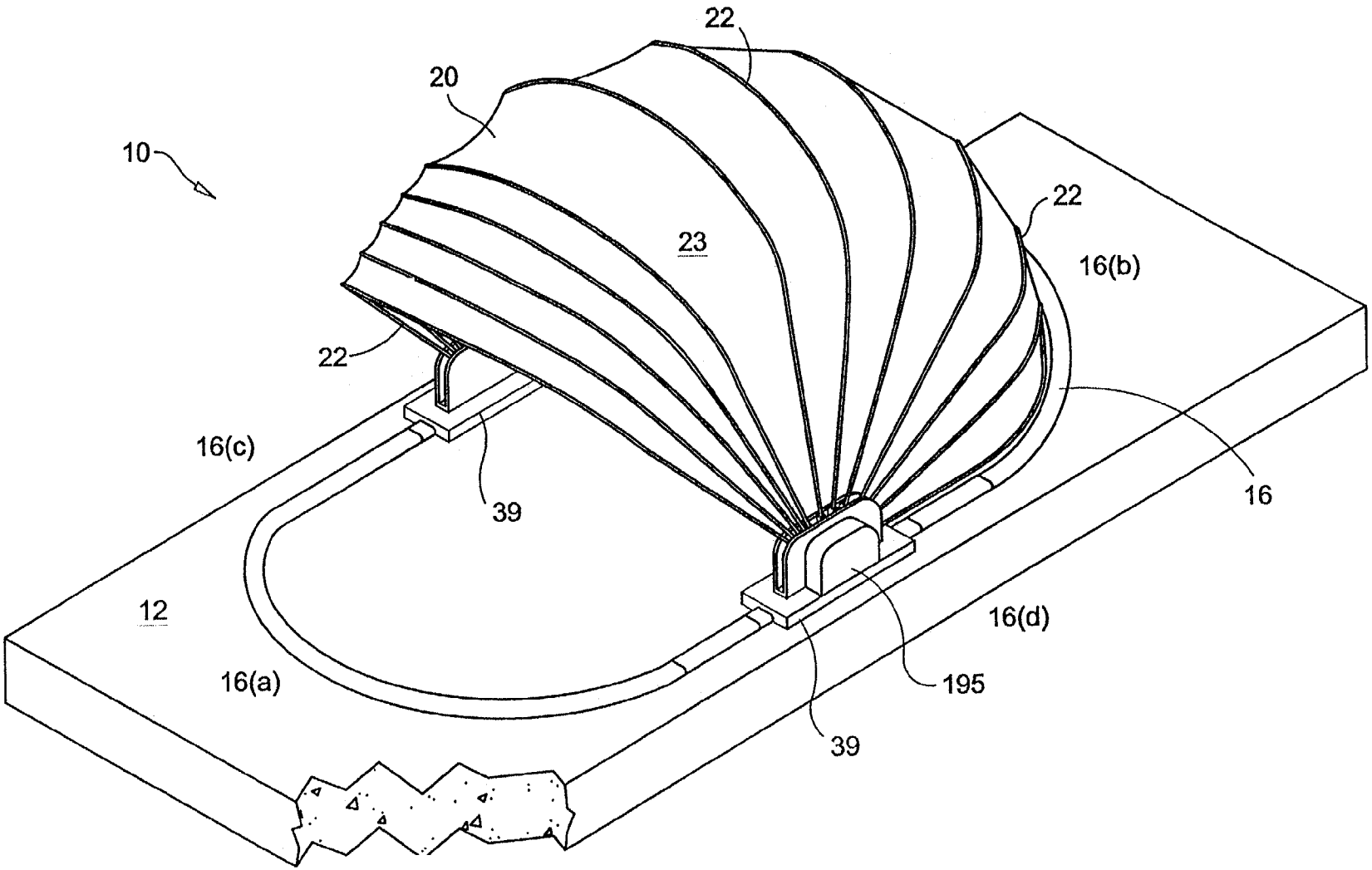
FIG. 5 is a perspective view of an assembled shelter in a partially opened state.

As best seen in FIGS. 2 and 4, ribs (22) are independently and rotatably connected to corresponding flanges (31) and (35) on the right side of the device, the left side of the device being a mirror image of the right side, with the exception that there does not have to be (but there can be if desired) a motor and gear assembly (discussed below) associated with both the left and right side hinge mechanisms. One-half of the ribs are connected to forward flange (31) (and to a corresponding mirror-image flange (not shown) on right side (16*d*) of the shelter). The other half of the ribs are connected to rear flange (35) (and to a corresponding mirror-image flange (not shown) on right side (16*d*) of the shelter).

Figure 3:
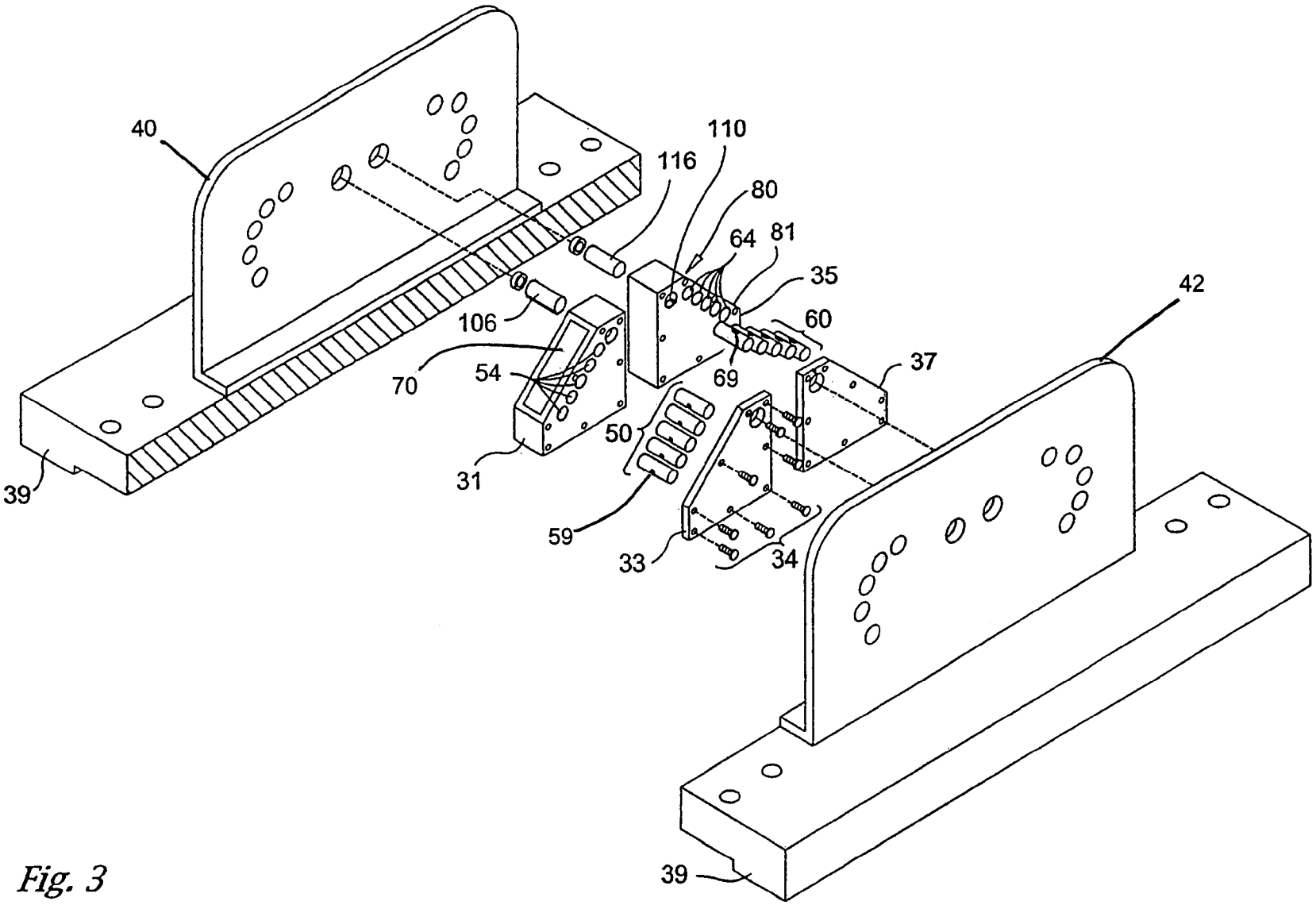
FIG. 3 is an exploded view of the hinge apparatus of FIG. 2 positioned between a pair of base plates.
Figure 9:
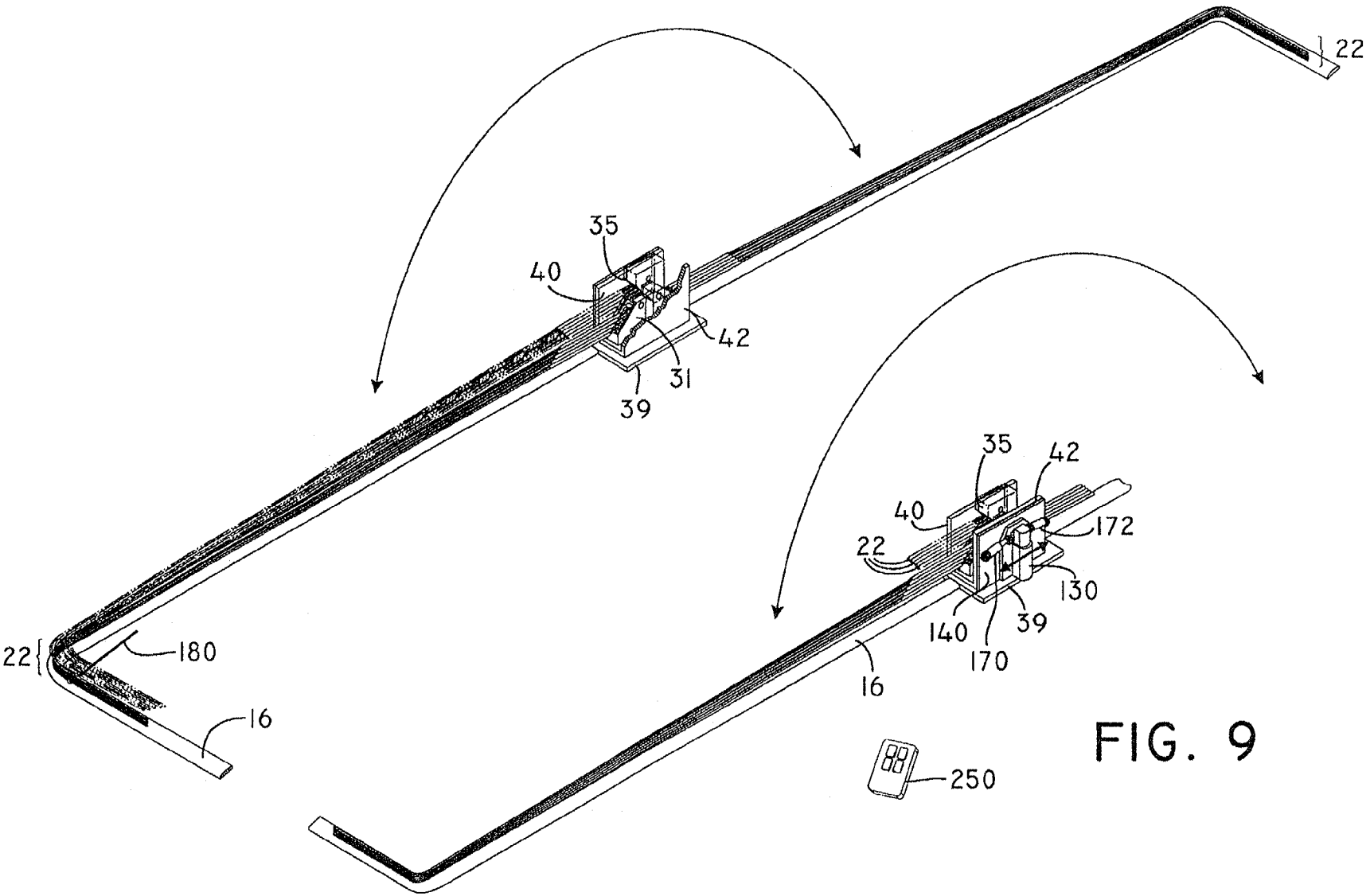
FIG. 9 is a perspective view of the shelter of the instant invention in the fully opened position.

Flanges (31) and (35) are rotatably positioned between base plates (40) and (42), as best seen in FIG. 3 and 9. Plates (40) and (42) are connected to frame (16) in any known manner such as by anchoring to support (39). A pair of facing plates (33), (37) are attached to one side of flanges (31), (35) using fasteners (34). A plurality of attachment dowels (50) are rotatably disposed in corresponding cylindrical apertures (54) in forward flange (31), and attachment dowels (60) are rotatably disposed in cylindrical apertures (64) in rear flange (35). Face plates (33), (37) are then attached to flanges (31), (35), respectively, to retain dowels (50) and (60) in place within the respective flanges. As illustrated in FIGS. 2 and 3, openings (70) and (80), through which the terminal ends (22') of ribs 22 are placed, are defined by transversely oriented surfaces (71), (81), respectively, in flanges (31), (35).

Figure 7:
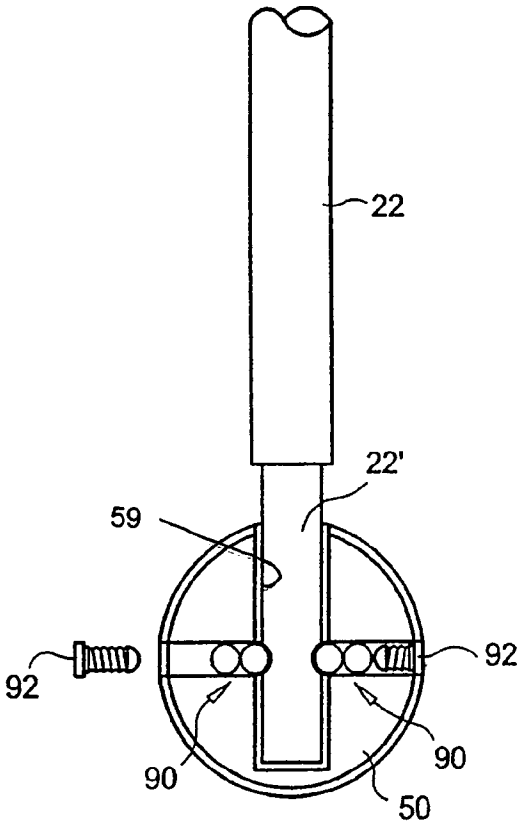
FIG. 7 is a cross-sectional elevational view of the connection of one rib and a rib attachment dowel.

Through these openings are placed terminal ends (22') of ribs (22), as best seen in FIG. 2. Ends (22') of ribs (22) are held in place within apertures (59), (69) of dowels (50), (60) by set screws (92) and steel balls (90), which mate within correspondingly shaped cutouts 91 made in terminal ends (22') of ribs (22), as best seen in FIG. 7.

It can therefore be seen that ribs (22) articulate relative to flanges (31), (35) to the extent that dowels (50), (60) are able to rotate within apertures (54), (64). However, in the preferred embodiment, one end of the forward lowermost rib (22) is fixedly secured to flange (31) and connected to a mirror-image flange (not shown) on the right side of the shelter, a magnitude of rigidity to the cover as it is rotated open. The lowermost rib to the rear (16*b*) of the device is also, in the-preferred embodiment, fixed to flange (35) and to the corresponding flange on right side (16*d*)

Figure 6:
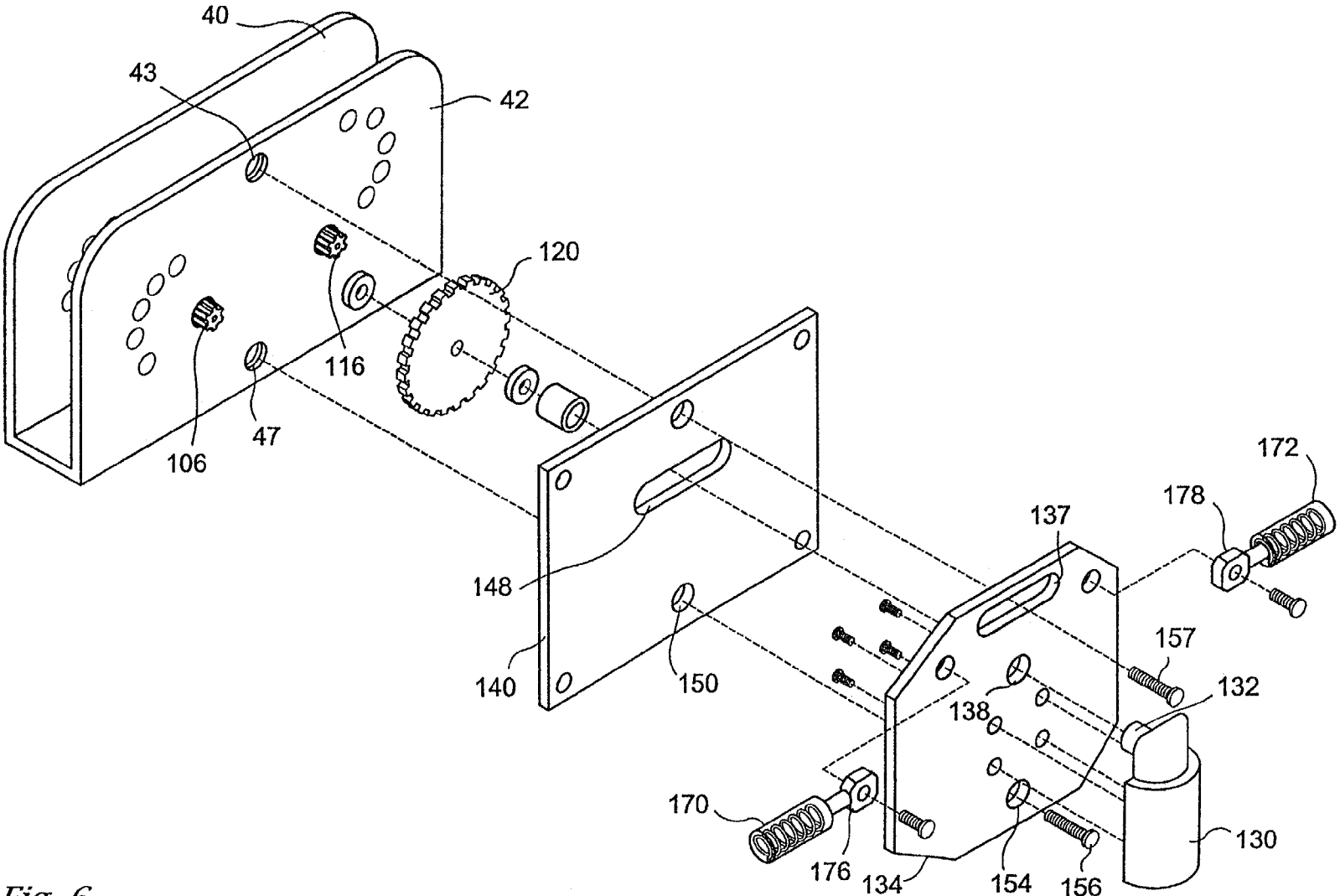
FIG. 6 is an exploded perspective view of the motor and motor/switching arrangement of the invention.

A keyed aperture (100) is defined by flange (31), through which is adapted to be placed a corresponding keyed pin (106). Similarly, a keyed opening (110) is defined by flange (35) through which is adapted to be placed keyed pin (116). As illustrated in FIG. 6, keyed pins (106) and (116) are rotated by a gear (120) which in turn is connected to a motor (130). Motor (130) is connected to motor mounting plate (134), and the output shaft (132) of motor (130) extends through a shaft opening (138) in mounting plate (134) and through a corresponding output shaft slot (148) disposed in intermediate plate (140). Mounting plate (134) pivotally mounts to intermediate plate (140) via through bolt (156) passing through aperture (154) in mounting plate (134) and aperture (150) disposed in intermediate plate (140). Through bolt (156) threadingly engages aperture 47 of mounting plate (42). A pair of actuators (170), (172) such as solenoids, are connected via clevis connections (176), (178) to mounting plate (134). Actuators (170) and (172) are utilized to cause mounting plate to tilt back and forth relative to intermediate plate (140) and base plates (40) and (42) to cause gear (120) to either engage the splined end of pin (106) or a splined end of pin (116), depending upon whether actuator (170) or actuator (172) is engaged. Guide bolt (157) may be employed to guide plate (134) through its range of tilting. Bolt (157) passes through slot (137) in mounting plate (134) and attached through threaded aperture (43) of plate (42).

It can therefore be seen that, upon actuation of actuator (170), part (134) will pivot slightly to the left, causing gear (120) to engage the splined end of pin (106) which in turn will cause flange (31) to rotate. This in turn will cause the cover on that (forward) side of the shelter to be opened or closed, depending upon the direction of rotation of the output shaft (132) of motor (130). Likewise, if actuator (172) is employed, mounting plate (134) will rotate slightly to the right, causing gear (120) to become disengaged from pin (106) and to engage the splined end of pin (116) causing flange (35) to rotate to open or close that (rear) side of the cover.

A motor and hinge cover (195) may be used to enclose motor(s) (130) and the hinge mechanisms on either side of this device.

A reinforcing strap (180) may be employed to connect flange (31) to any remote portion of bottom most rib (22). The purpose of this reenforcement strap (180) is to transfer a portion of the forces from movement of flange (31) to the rib to which is attached upon rotation of flange (31) from the fully closed position.

Figure 8:
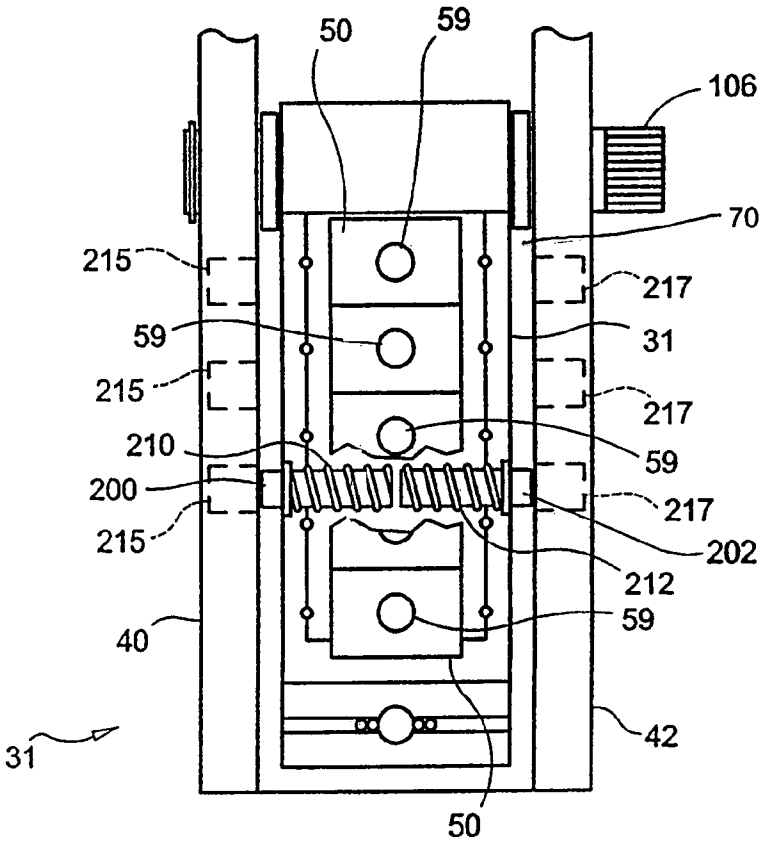
FIG. 8 is a front elevational view of an assembled flange.

In FIG. 8, flange (31) can be seen mounted between plates (40) and (42). Since it is desirable to provide a means for locking the cover in a variety of positions, e.g. opened on one side, opened on both sides, closed on both sides, partially opened on one side and/or the other, a provision is made for so doing in the form of a pair of locking pins (200), (202) and solenoids (210), (212) which are movably associated with flange (31). A similar arrangement is provided in connection with flange (35), as well as (in one embodiment) the flanges on the other side of the device. A plurality of corresponding sockets (215) are disposed in plate (40) and a plurality of corresponding sockets (217) are disposed in plate (42). Upon actuation of solenoids (210) and (212), locking pins (200) and (202) will be forced outwardly to engage the nearest of the locking apertures (215), (217) respectively. Any number of such locking apertures may be provided with the invention. It is most desired to at last have locking apertures associated with the fully closed and fully opened positions as well as a plurality of intermediate positions, such as that shown in FIG. 5.

The motor housing or cover (195) may be provided to protect the motor, gears, etc, from exposure to the elements. In addition, remote actuation apparatus is preferably employed, such as a key fob (250) similar to the type used to actuate remote controlled automobile door locks. A power source such as a battery (not shown) is employed to operate any electrically powered apparatus such as actuators (170) and (172) and coils (210), (212). Alternatively, provision can be made for manually locking the flanges in any particular angular orientation. This can be carried out by any means which will occur to one of skill in the art. Likewise, tilting motor mounting plate (134) to the left or right in FIG. 6 can be carried out manually as opposed to using actuator (170), (172), again in a manner which will occur to one of skill in the art. For example, a simple lever can be connected to plate (134) and manually manipulated by an operator to cause mounting plate, and motor (130), to be tilted to the left or right to engage pin (106) or pin (116) respectively. In addition, rotation of flange (31) and the other flanges, can be done, for example, by sliding a pin through an aperture open to the exterior of the shelter, similar to the use of a pin in connection with a weight lifting device, where locking pins are placed between weight plates and through any one of a variety of apertures disposed in a tube upon which the plates reciprocate during a weight lifting routine.

It is to be understood that the inventions disclosed herein are not limited to the precise constructions shown and described but that changes are contemplated which will readily fall within the spirit of the invention as shall be determined by the scope of the following claims.

What is claimed is:

1. A shelter for personal articles comprising:

a plurality of cover support members, each cover support member having a first end and a second end;

a substantially flexible cover member attached to the cover support members;

opposed hinge mechanisms associated with opposite medial sides of a base of the shelter, each said hinge mechanism including:

a first flange pivotally connected to a base bracket, first ends of a first set of said cover support members being pivotally connected to said first flange; and a second flange pivotally connected to said base bracket and positioned opposite said first flange, first ends of a second set of said cover support members being pivotally connected to said second flange;

each of said first and second flanges being independently rotatable between a first position and a second position, such that each of the first set and the second set of cover support members are independently adjustable into closed and open positions.

2. The shelter of claim 1, wherein each of the first flange and the second flange defines a respective plurality of cylindrical apertures and wherein each of the opposed hinge mechanisms further include:

a plurality of attachment dowels disposed within the cylindrical apertures, each dowel defining a respective positioning aperture for receiving an end of a corresponding cover support member;

wherein the attachment dowels rotate within the cylindrical apertures to facilitate adjustment of the first set and the second set of cover support members into open and closed positions.

3. The shelter of claim 2, wherein each attachment dowel further defines at least one fastening aperture arranged substantially perpendicular to the positioning aperture, wherein each fastening aperture is adapted to receive a fastener; and wherein the end of the cover support member that is inserted into the positioning aperture defines at least one cutout positioned and adapted to receive the fastener from the fastening aperture.

4. The shelter of claim 1, further including a motor associated with at least one of the hinge mechanisms to facilitate automated opening and closing of the cover member.

5. The shelter of claim 4, wherein the at least one of the hinge mechanisms further includes:

a first keyed pin positioned within a first keyed aperture defined by the first flange, the first keyed pin including a first plurality of gear teeth;

a second keyed pin positioned within a second keyed aperture defined by the second flange, the second keyed pin including a second plurality of gear teeth, each of the first keyed pin and the second keyed pin being pivotally associated with the base bracket; and a gear, connected to an output shaft of the motor, for driving at least one of the first plurality of gear teeth and the second plurality of gear teeth.

6. The shelter of claim 5, further comprising:

a mounting plate pivotally connected to the base bracket, wherein the output shaft of the motor attaches to the gear through an aperture in the mounting plate; and a pair of actuators connected to the mounting plate and adapted to tilt the mounting plate between a first position and a second position, the first position corresponding to a position in which the gear engages the first plurality of gear teeth and the second position corresponding to a position in which the gear engages the second plurality of gear teeth.

7. The shelter of claim 6, further comprising means for selectively operating the actuators.

8. The shelter of claim 6, wherein the pair of actuators comprises solenoids.

9. A shelter for personal articles comprising:

a moveable cover including a flexible envelope and a plurality of independently articulatable ribs, each of the ribs having a first end and a second end;

a pair of spaced base hinges, each base hinge including a pair of pivoting flanges and a plurality of pivoting attachment dowels, each flange adapted to receive respective ends of half of the plurality of the ribs; and wherein each flange of each base hinge is adapted to receive respective ends of half of the plurality of the ribs and wherein each attachment dowel pivotally connects the received end of a rib to a corresponding one of the flanges.

10. The shelter of claim 9, further including a motor associated with at least one of the base hinges to facilitate automated opening and closing of the cover.

11. The shelter of claim 10, wherein the at least one of the base hinges further includes:

a first keyed pin positioned within a first keyed aperture defined by a first flange of the pair of pivoting flanges, the first keyed pin including a first plurality of gear teeth;

a second keyed pin positioned within a second keyed aperture defined by a second flange of the pair of pivoting flanges, the second keyed pin including a second plurality of gear teeth, each of the first keyed pin and the second keyed pin being pivotally associated with a corresponding one of the flanges; and a gear, connected to an output shaft of the motor, for driving at least one of the first plurality of gear teeth and the second plurality of gear teeth.

12. The shelter of claim 11, further comprising:

a mounting plate pivotally connected to the at least one base hinge, wherein the output shaft of the motor attaches to the gear through an aperture in the mounting plate; and a pair of actuators connected to the mounting plate and adapted to tilt the mounting plate between a first position and a second position, the first position corresponding to a position in which the gear engages the first plurality of gear teeth and the second position corresponding to a position in which the gear engages the second plurality of gear teeth.

13. The shelter of claim 12, further comprising means for selectively operating the actuators.

14. The shelter of claim 12, wherein the pair of actuators comprises solenoids.

* * * * *